US006195816B1

(12) United States Patent
Glassman

(10) Patent No.: US 6,195,816 B1
(45) Date of Patent: Mar. 6, 2001

(54) SHOWER CURTAIN RETAINING SYSTEM

(76) Inventor: Elliot Glenn Glassman, 53 Chesterfield Lakes, Chesterfield, MO (US) 63005

( * ) Notice: Subject to any disclaimer, the term of this patent is extended or adjusted under 35 U.S.C. 154(b) by 0 days.

(21) Appl. No.: 09/378,623

(22) Filed: Aug. 20, 1999

(51) Int. Cl.[7] ..... A47K 3/38

(52) U.S. Cl. ..... 4/609

(58) Field of Search ..... 4/608, 609, 610

(56) References Cited

U.S. PATENT DOCUMENTS

| | | | | |
|---|---|---|---|---|
| 3,500,481 | * | 3/1970 | McKwane | 4/558 |
| 3,808,610 | | 5/1974 | Mortensen | 4/558 |
| 3,879,806 | | 4/1975 | Armstrong | 4/610 |
| 4,088,174 | * | 5/1978 | Edwards | 4/608 X |
| 4,197,616 | | 4/1980 | Panuski | 248/205.7 X |
| 4,258,443 | * | 3/1981 | Baus | 4/610 X |
| 4,361,914 | * | 12/1982 | Oliver | 4/610 X |
| 4,594,741 | | 6/1986 | Payne | 4/558 |
| 4,887,324 | | 12/1989 | Cairns | 4/609 |
| 5,023,964 | | 6/1991 | Unsworth | 4/558 |
| 5,033,132 | | 7/1991 | Greenblatt | 4/608 |

FOREIGN PATENT DOCUMENTS 997670 9/1976 (CA) .

* cited by examiner

*Primary Examiner*—Robert M. Fetsuga
(74) *Attorney, Agent, or Firm*—Greensfelder, Hemker & Gale, P.C.

(57) ABSTRACT

A shower curtain retaining system for use particularly in connection with shower enclosures above conventional bathtubs for retaining the lower portion of a shower curtain inside the bathtub whenever the shower curtain is forced outward over the lip of the bathtub. Preferably, the shower curtain retaining system comprises a fastening member attached to the lower portion of the shower curtain and a retention member securely attached to the inner surface of the bathtub generally opposite and above the fastening member. Fastening means includes a plurality of hooks spaced equally apart along a lateral strip. The plurality of hooks are adapted to engage at least a portion of a rail which extends outwardly from and laterally along the retention member. In operation, when the lower portion of the shower curtain is forced outward, the fastening member is concurrently moved upward into engagement with the retention member which securely engages the fastening member thereto for as long as the shower curtain is forced outward over the lip of the bathtub.

13 Claims, 7 Drawing Sheets

SHOWER CURTAIN RETAINING SYSTEM

BACKGROUND OF THE INVENTION

1. Field of the Invention

The present invention generally relates to a shower curtain retaining system, and more particularly to a shower curtain retaining system for retaining the bottom portion of a shower curtain inside a bathtub enclosure. More specifically, the present invention relates to a shower curtain retaining system which employs a retaining means that prevents the bottom portion of the shower curtain from falling outside the bathtub when the shower curtain is forced outward.

2. Prior Art

Shower curtain retaining systems for retaining a shower curtain are well known in the art. Typically, a prior art shower curtain retaining system comprises a retaining means for engaging and retaining either vertical end of a shower curtain to a respective bathtub enclosure wall in order to prevent the inadvertent escape of shower spray. U.S. Pat. No. 3,879,806 to Armstrong is typical of prior art retention system which comprise some type of vertical connecting means for holding the marginal vertical edge portion of a hanging shower curtain in contiguity with a bathtub enclosure wall to prevent shower spray from splashing outwardly between the shower curtain and the enclosure wall. Unfortunately, such prior art retention systems still permit water to spray out from the bathtub when the bottom portion of the shower curtain is inadvertently forced over the lip of the bathtub.

U.S. Pat. No. 5,033,132 to Greenblatt partially addresses this problem of shower spray by providing a shower curtain with a plurality of magnets attached along the lower portion of the shower curtain. The magnets tether the lower portion of the shower curtain to the inner surface of the bathtub and prevents its movement when the shower curtain is inadvertently forced outward. However, the magnets of the Greenblatt system substantially inhibit lateral side-to-side movement of the shower curtain by the user since the magnets function as stationary retainers that anchor the shower curtain to interior surface of the shower enclosure. The user must first detach the magnets from the inner surface of the bathtub before the shower curtain may be moved aside.

Therefore, there is a need in the art for a shower curtain retaining system that effectively retains the lower portion of the shower curtain inside the bathtub when the shower curtain is forced outward over the lip of the bathtub, while also permitting uninhibited lateral side-to-side movement of the shower curtain.

OBJECTS AND SUMMARY OF THE INVENTION

In brief summary, the present invention overcomes and substantially alleviates the deficiencies in the prior art by providing a shower curtain retaining system that retains the shower curtain inside the bathtub enclosure while permitting uninhibited lateral movement of the shower curtain. In the preferred embodiment, the shower curtain retaining system according to the present invention comprises a first retaining strip which includes a plurality of hook members laterally spaced along the strip. The fastening strip is attached to the bottom portion of a shower curtain on the side closest the inner surface of the bathtub. A retaining strip is provided along the inner surface of the bathtub in a generally opposite and raised location relative the fastening strip attached to the shower curtain. A rail member, preferably comprising a thin cable or wire which is laterally spaced along and attached to the retaining strip by a plurality of posts that extend outwardly from the strip.

Preferably, the method of mounting the shower curtain retaining system is to attach the fastening strip laterally along the lower portion of the shower curtain on the side closest to the bathtub so that the hook members are oriented upward. Once the fastening strip is attached, the retaining strip is laterally attached along the inner surface of the bathtub in a generally opposite and raised location relative to the fastening strip on the side closest to the shower curtain. Any conventional means of attachment may be used to attach the fastening and retaining strips to the shower curtain, for example, adhesive bonding, fasteners, magnet or the like. Alternatively, the strips could be made integral with the shower curtain. Although the preferred arrangement is to have the fastening strip attached to the shower curtain in a lower orientation relative to the retaining strip attached to the inside surface of the bathtub, alternative arrangements could include attaching the fastening strip to the inner surface of the bathtub and the retaining strip to the shower curtain in similar orientation as the preferred arrangement with the hook members facing downward rather than upward.

In operation, the shower curtain retaining system of the present invention prevents the lower portion of the shower curtain from falling over the lip of the bathtub due to the interaction of the fastening strip with the retaining strip when the shower curtain is forced outward over the lip of the bathtub. When the shower curtain is forced outward, the lower portion of the shower curtain slides upward along the inner surface of the bathtub until the hook members of the fastening strip engage the rail member of the retaining strip. Each hook member of the fastening strip forms a hooked shaped curved portion which defines a retention area adapted to securely engage the rail member therein. As the lower portion of the shower curtain is forced outward over the lip of the bathtub the lower portion of the shower curtain is concurrently raised upward along the inner surface of the bathtub until one or more of the hook members engage the rail member of the retaining strip. This secure engagement between the retaining strip and the fastening strip prevents the lower portion of the shower curtain from slipping over the lip of the bathtub and allow shower spray to escape the bathtub enclosure. The force of the shower curtain being moved outward will cause the hook members to remain engaged to at least a portion of the rail member until the shower curtain is no longer forced outward and is allowed to fall back down to its original at-rest position. This fastener/retention strip arrangement also permits uninhibited lateral movement of the shower curtain since the present invention does not depend upon stationary retainers to retain the shower curtain inside the bathtub enclosure.

Accordingly, a primary object of the present invention is to provide a shower curtain retaining system that retains the lower portion of the shower curtain within the enclosure of the bathtub, while also permitting uninhibited lateral movement of the shower curtain.

Another object of the present invention is to provide a shower curtain retaining system that prevents the bottom of the shower curtain from being forced over the lip of the bathtub.

A further object of the present invention is to provide an easy method of affixing a shower curtain retaining system to a bathtub and shower curtain.

Another further object of the present invention is to provide a shower curtain retaining system that prevents the escape of shower spray from the bathtub enclosure.

Another object of the present invention is to provide a shower curtain retaining system that does not inhibit the lateral movement of the shower curtain along the bathtub.

These and other objects of the present invention are realized in a presently preferred embodiment thereof, described by way of example and not by way of limitation, which provides for a shower curtain retaining system that retains the lower portion of a shower curtain within the confines of the bathtub enclosure, while also permitting free lateral movement of the shower curtain.

DETAILED DESCRIPTION OF THE INVENTION

As shown in the exemplary drawings for the purposes of illustration, a preferred embodiment of the shower curtain retaining system in accordance with the principles of the present invention, referred to generally by reference 10, is provided for securely retaining the lower portion of a shower curtain 16 within the confines of a bathtub 14 when the of shower curtain 16 is forced outward over the lip 34 of bathtub 14.

Figure 1:
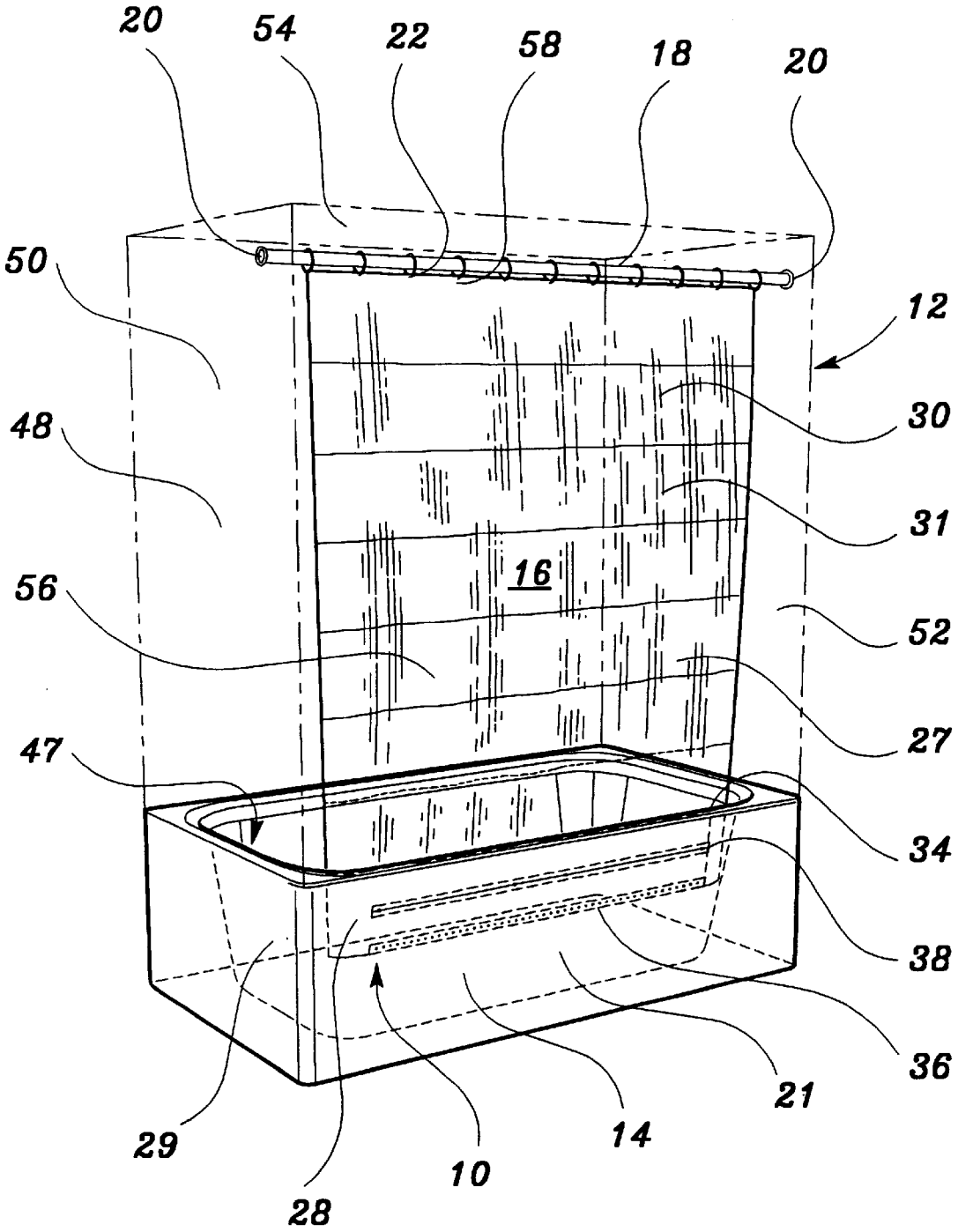
FIG. 1 is a perspective view of a bathtub enclosure shown with the shower curtain retaining system according to the present invention.

FIG. 1 shows a typical shower enclosure 12 comprising a back wall 48, top wall 54 and opposing side walls 50, 52 that define an opening 56. Extending across opening 56 is a rod 18 supported between posts 20 located on opposing walls 50, 52, of shower enclosure 12. To support shower curtain 16, a plurality of retaining rings 22 hang from rod 18 with each ring extending through apertures 58 formed along the top portion 30 of shower curtain 16. Bathtub 14 includes an interior surface 21 which defines an interior volume 47 having a lip 34 formed along the outer upper edge of bathtub 14.

Figure 2A:
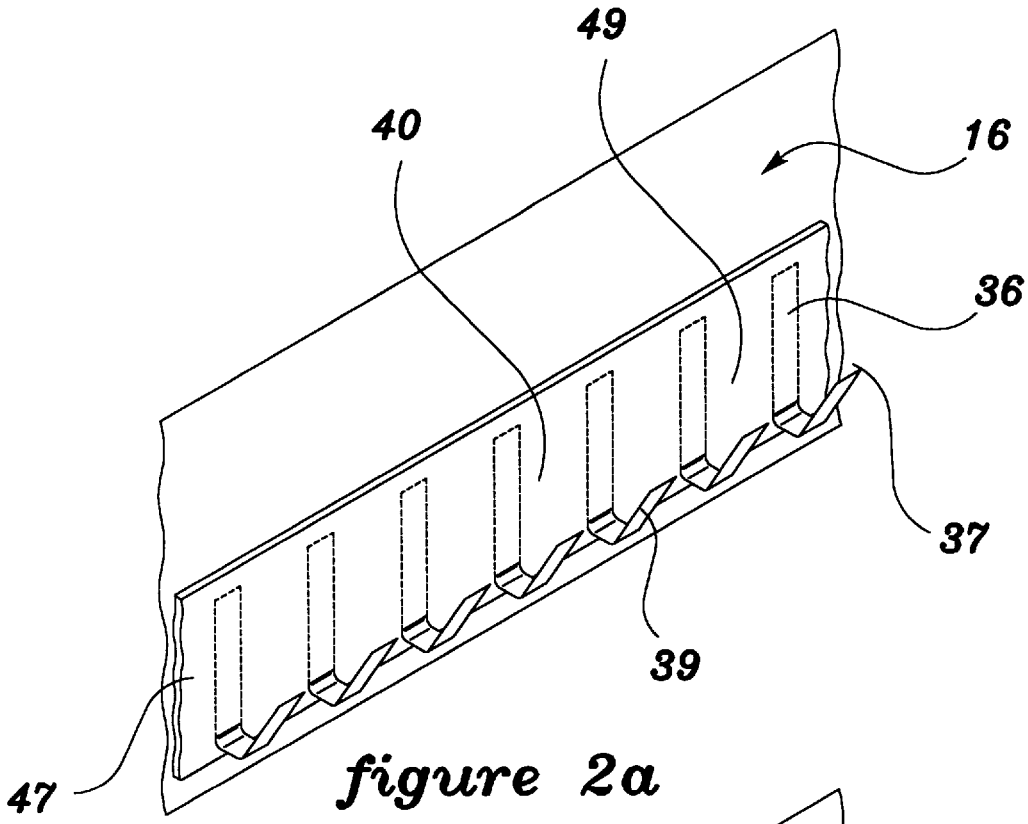
FIG. 2*a* is a partial perspective view of the preferred embodiment of the fastening strip according to the present invention.
Figure 2B:
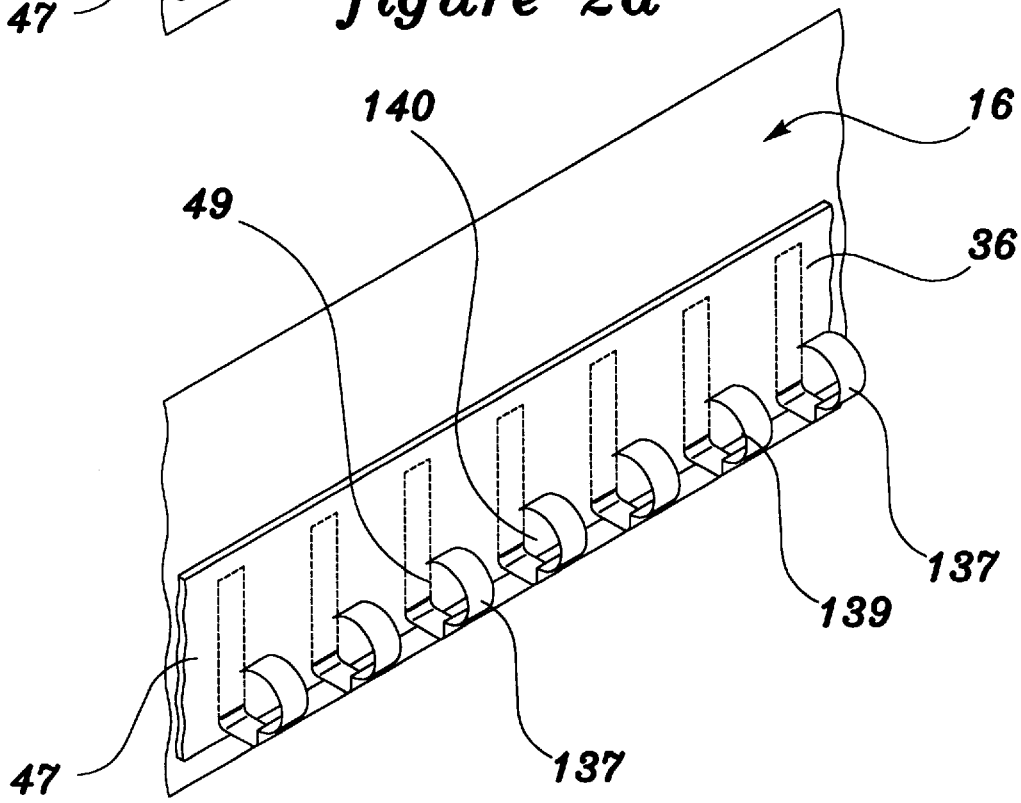
FIG. 2*b* is a partial perspective view of an alternative embodiment of the fastening strip according to the present invention.

In the preferred embodiment, a fastening strip or member 36 is attached substantially along an entire length of the lower portion 28 of shower curtain 16 using conventional means of attachment, including, but not limited to adhesive strip, glue, solvent bonding or other conventional means of attachment. The fastening strip may also be integrally molded with the shower curtain 16 during manufacture. Referring to FIG. 2*a*, fastening member 36 has a base 47 that includes a plurality of hooks 37 which are oriented upward with each hook 37 having a flexible angled portion 39. Each angled portion 39 has a retention area 40 with a mouth 49 formed between portion 39 and base 47. In an alternate embodiment shown in FIG. 2*b*, a hook 137 has a curved shape rather than an angled one with a curved portion 139 that extends outwardly in a generally curved path from base 47.

Figure 3:
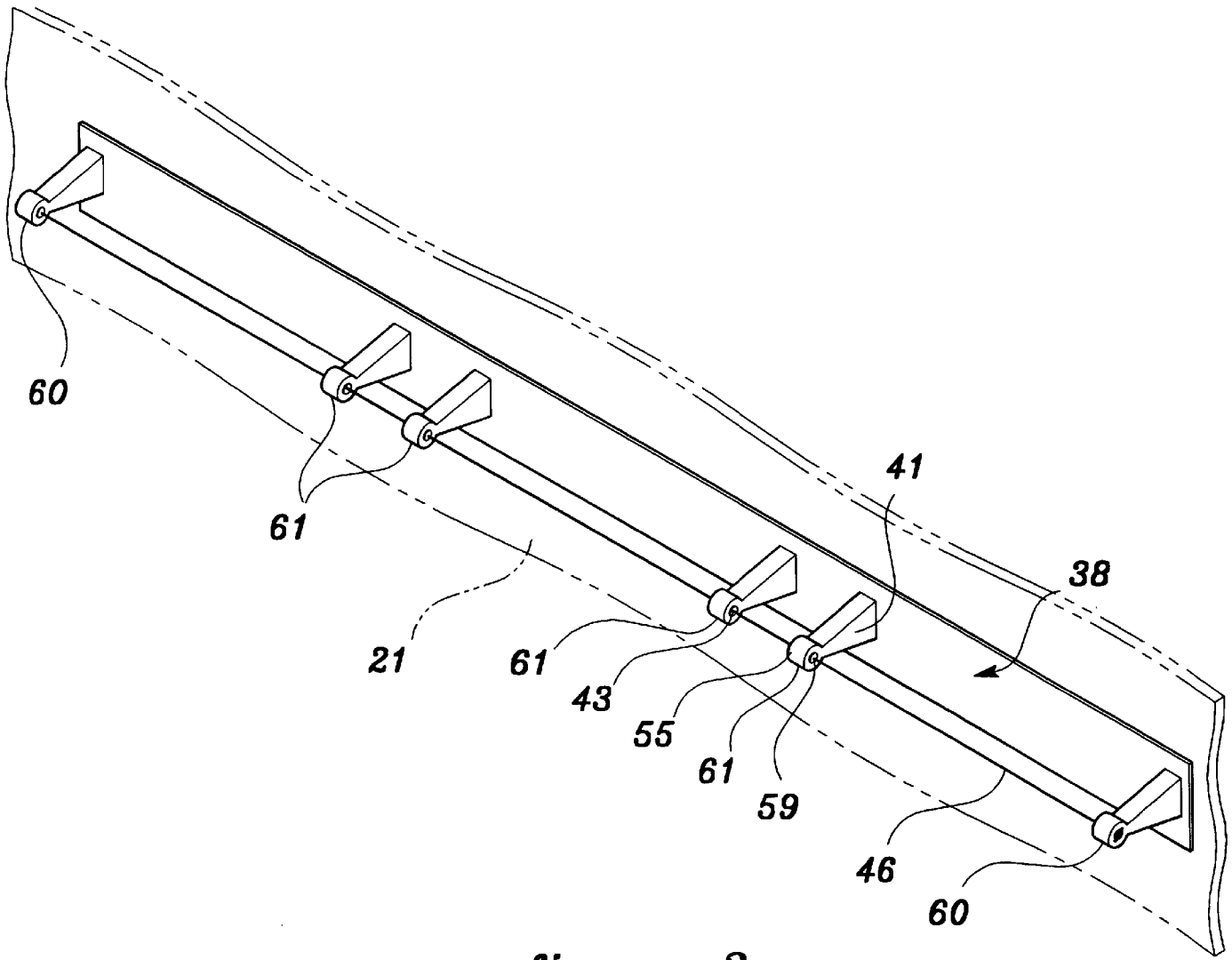
FIG. 3 is an isolated perspective view of the retaining strip according to the present invention.

Referring to FIGS. 1 and 3, a retention strip or member 38 is provided along a portion of inner surface 21 of the bathtub 14 directly opposite the outer surface 27 of shower curtain 16. Retention member 38 is attached in a location generally opposite and above the fastening strip 36 and includes at least two posts 43 which extend outwardly from a base 41. Each post 43 comprises a head post 55 having an aperture 59 adapted to receive a rail 46 that extends from two end posts 60.

In the preferred embodiment shown in FIG. 3, at least one or more intermediate posts 61 may be equally spaced along retention member 38 between end posts 60 with the rail 46 extending through each aperture 59 of each post 43, although alternatively only two end posts may be used. Rail 46 is preferably a flexible metal wire, however the wire may be of varying flexibility and thickness, and be composed of other materials, such as plastic, nylon etc., and still fall within the spirit and scope of the present invention.

Figure 4A:
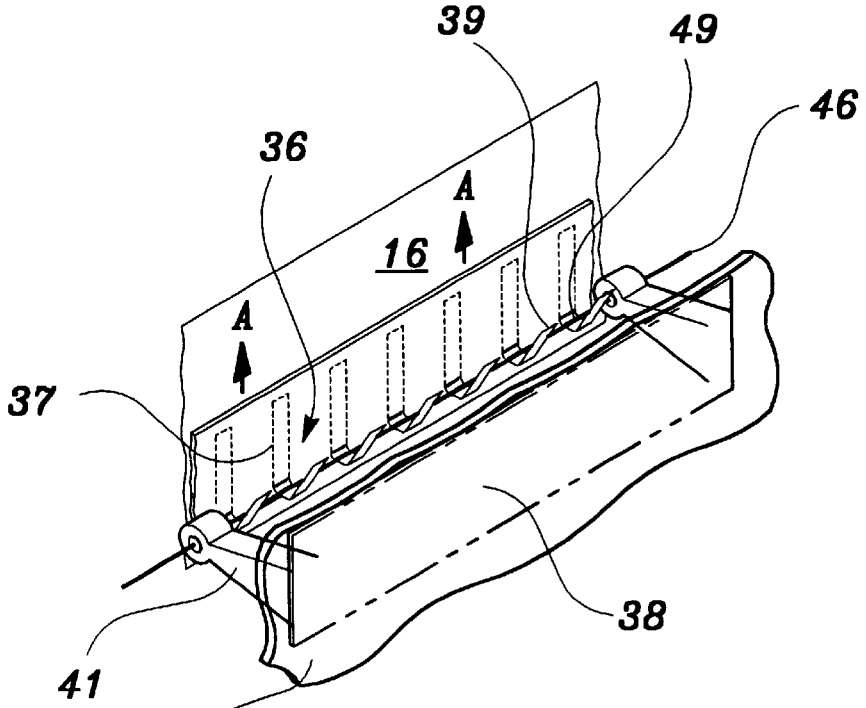
FIG. 4*a* is a partial perspective view showing the preferred embodiment of the fastening strip engaged to the retaining strip according to the present invention.
Figure 4B:
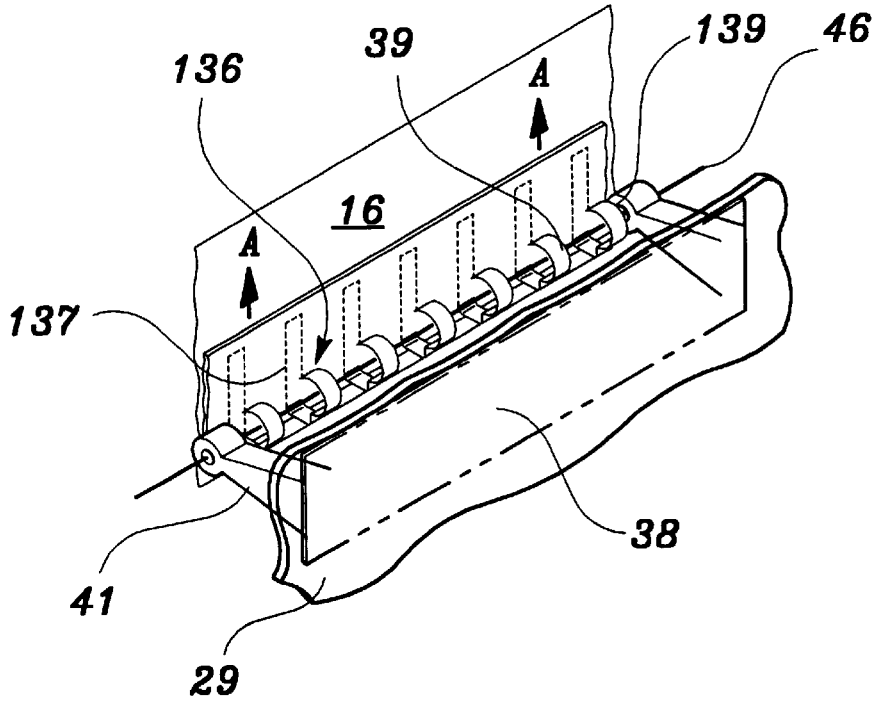
FIG. 4*b* is a partial perspective view showing an alternative embodiment of the fastening strip engaged to the retaining strip according to the present invention.
Figure 6:
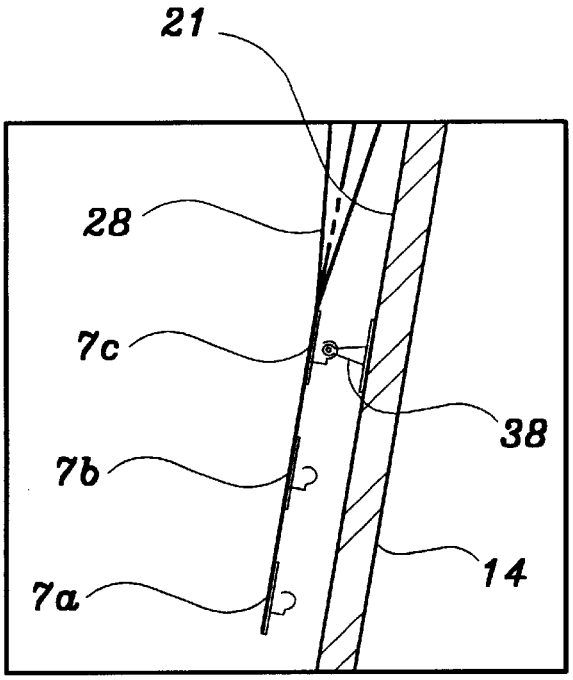
FIG. 6 is an enlarged view of the sequence of engagement shown in FIG. 5 according to the present invention.
Figure 5:
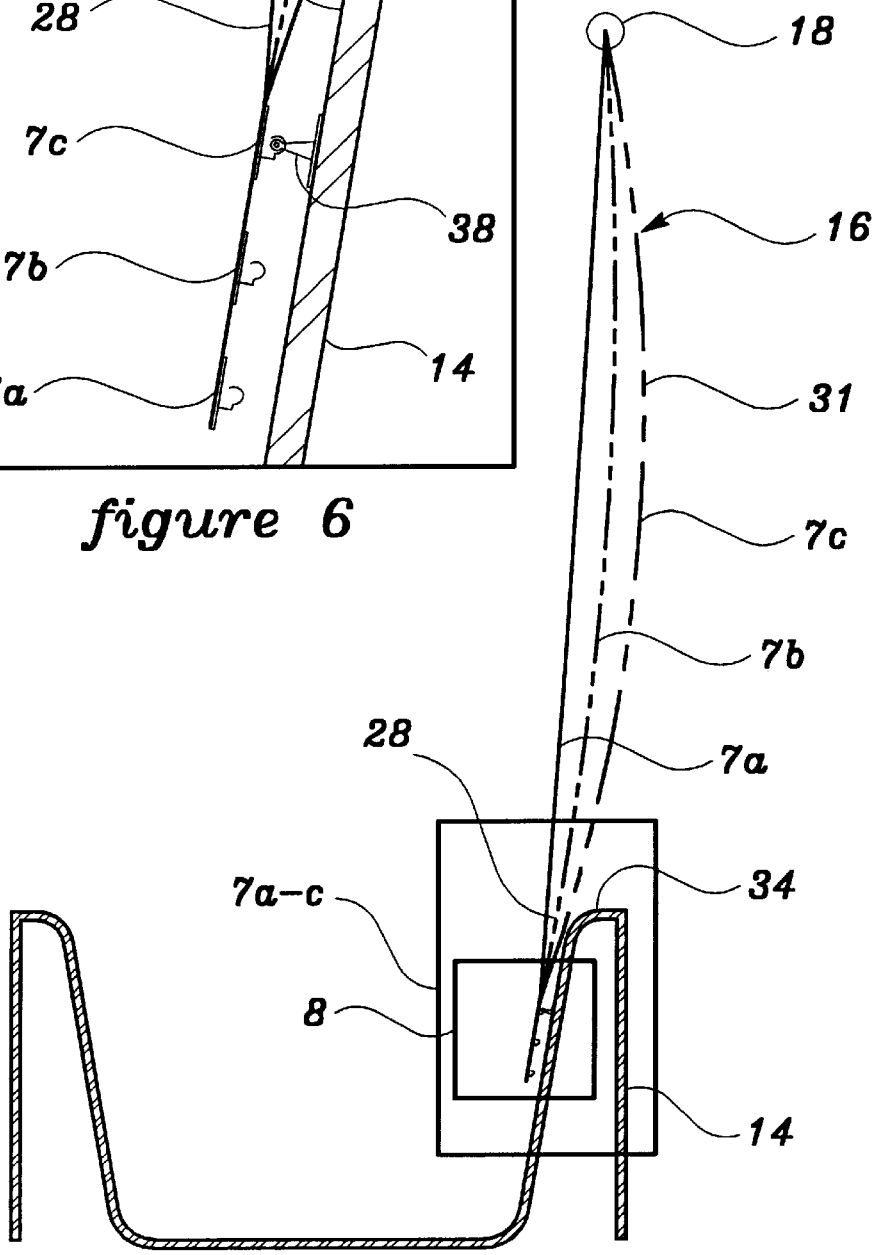
FIG. 5 is a partial cross-sectional view of the shower curtain retaining system showing a superimposed sequence of engagement between the fastening strip and the retaining strip according to the present invention.
Figures 7A, 7B, 7C:
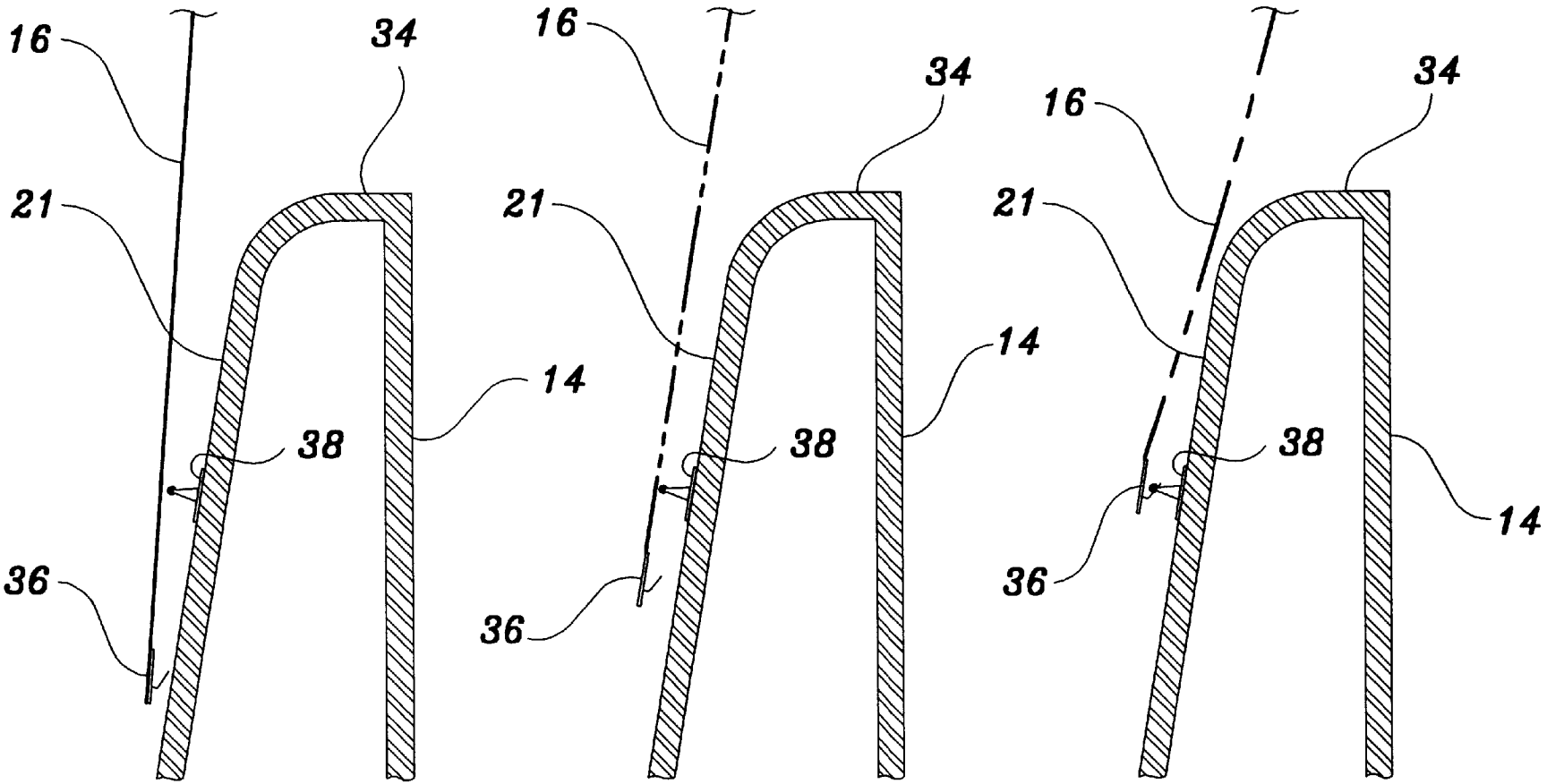
FIGS. 7*a–c* are enlarged isolated views illustrating each sequence of engagement shown in FIG. 6 according to the present invention.

Referring to FIGS. 5, 6 and 7*a–c*, a cross sectional view showing the sequence of the fastening member 36 engaging the retention member 38 which illustrates the operation of the present invention. In the at-rest position illustrated in FIG. 7*a*, the fastening member 36 of shower curtain 16 rests with hooks 37 of fastening member 36 oriented upward adjacent the inner surface 21 of bathtub 14 and located below retention member 38. Regardless of whether a portion of the shower curtain 16 has been moved laterally sideways when the middle portion 31 of shower curtain 16 is forced outward over the lip 34 of the bathtub 14, as shown in FIG. 7*b*, the fastening member 36 will usually be forced along inner surface 21 towards engagement with retention member 38. Referring specifically to FIG. 7*c*, as the shower curtain 14 is forced farther over the lip 34 of bathtub 14 one or more of hooks 37 engage the rail 46 of retention member 38. FIG. 4*a* illustrates the upward direction A of the preferred fastening member 36 as it engages retention member 38 within retention area 40, while FIG. 4*b* shows an alternative embodiment of the fastening member 136 also in the engaging position. In the engagement position, the flexible angled portion 39 captures rail 46, within retention area 40 when contact is made with rail 46 thereby retaining the lower portion 28 of shower curtain 16 inside the bathtub 14. This sequence of engagement is also illustrated in FIG. 6, whereby the fastening member 36 goes from the at-rest position (FIG. 7*a*), to the engaging position (FIG. 7*b*) towards retention member 38, and finally to the engagement position (FIG. 7*c*) with retention member 38 securely engaged to fastening member 36. The shower curtain retaining system 10 of the present invention will remain in the engagement position for as long as the shower curtain 16 is forced outward over the lip 34 of the bathtub 14. Once the outward force ceases, the fastening member 36 releases from the retention member 38 and the lower portion 28 of the shower curtain 16 falls back to its original at-rest position.

Figure 8:
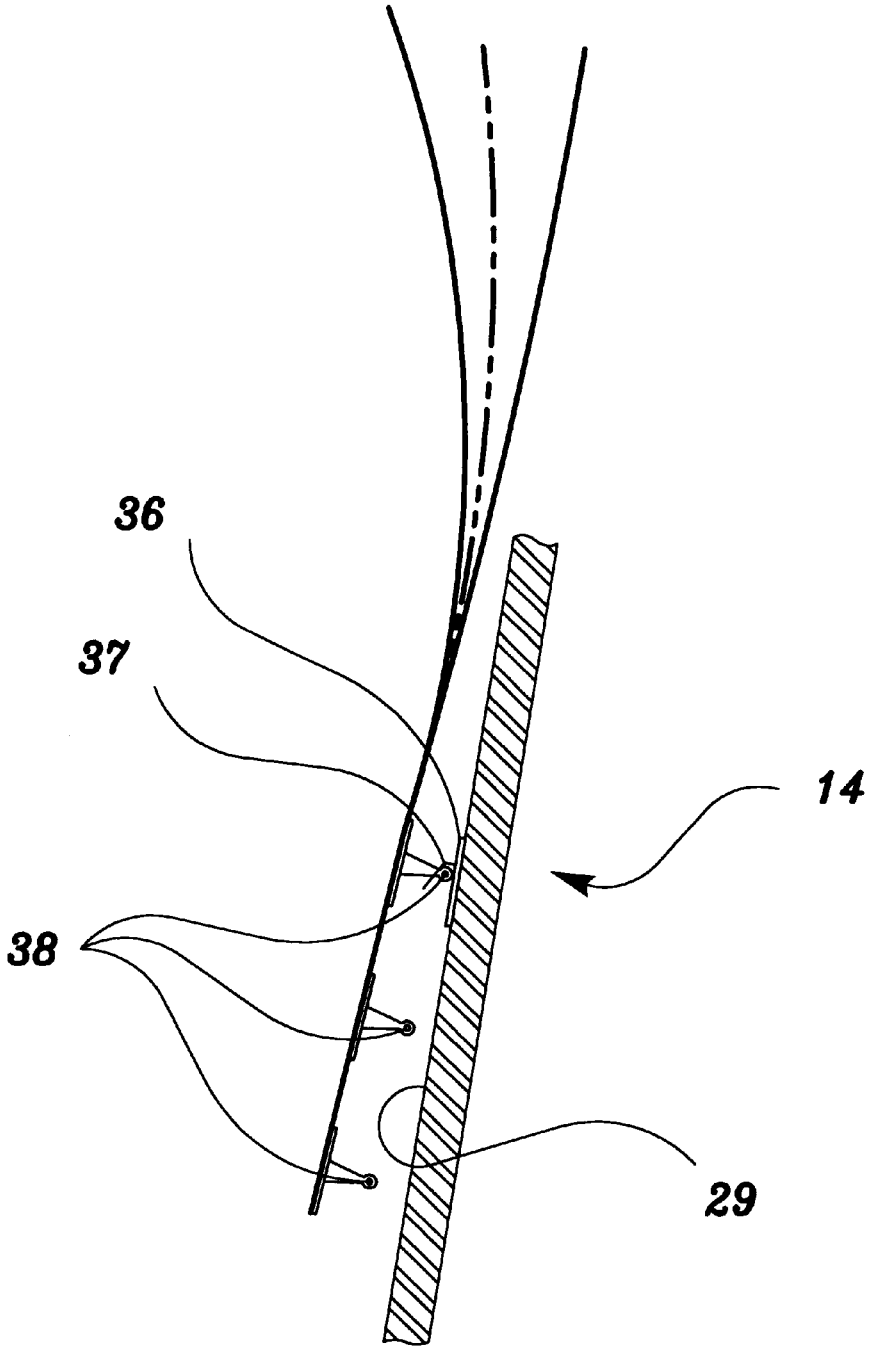
FIG. 8 is a cross sectional view of the alternate embodiment of the shower curtain retaining system showing the sequence of engagement according to the present invention.

Although the preferred embodiment of the present invention discloses the fastening member 36 as being attached to the shower curtain 16 with hooks 37 oriented upward facing the retention member 38, alternatively, the fastening member 36 and retention member 38 positions may be reversed. Referring to FIG. 8, the fastening member 38 is placed along a portion of the inner surface 29 of bathtub 14 having hooks 37 facing downward, while the retention member 38 is placed along the lower portion 28 of the shower curtain 16 and below the fastening member 36. In operation, the retention member 38 is forced upward towards the stationary fastening member 36 when the shower curtain 16 is forced outward over the lip 34 of the bathtub 14. The moving rail 46 would then be captured by one or more stationary hooks 37 in similar engagement as described above in the preferred embodiment.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

I claim:

1. A shower curtain retaining system comprising:

a shower curtain having upper and lower portions;

a bathtub defining an enclosure around said lower portion of said shower curtain, said bathtub including a side wall having an inner surface and an upper edge;

a first strip attachable to said lower portion of said shower curtain, said first strip including a plurality of hook members; and a second strip attachable to said inner surface of said bathtub, said second strip including a rail member having an elongated wire extending outwardly from and generally parallel to said second strip, whereby when said top portion of said shower curtain is forced outward over said upper edge at least one of said hook members engages a portion of said elongated wire and retains the lower portion of said shower curtain inside said enclosure.

2. The shower curtain retaining system according to claim 1, wherein each of said hook members includes an arm defining an interior retention area.

3. The shower curtain retaining system according to claim 2, wherein said interior retention area has a generally curved configuration.

4. The shower curtain retaining system according to claim 2, wherein said interior retention area has a generally angular configuration.

5. The shower curtain retaining system according to claim 1, wherein said plurality of hook members are spaced laterally along said first strip.

6. The shower curtain retaining system according to claim 1, wherein said second strip is attachable to said inner surface of said bathtub in a generally opposite and raised location relative to said first strip.

7. The shower curtain retaining system according to claim 1, wherein when said top portion of said shower curtain is pushed outward said lower portion is concurrently raised upward toward eventual engagement with at least a portion of said rail member.

8. The shower curtain retaining system according to claim 1, wherein said shower curtain is freely movable in a side-to-side lateral motion along said bathtub.

9. A shower curtain retaining system comprising:

a shower curtain having top and lower portions;

a bathtub defining an enclosure around said shower curtain, said bathtub including a side wall having an inner surface and upper edge;

a first strip attachable to said lower portion of said shower curtain, said first strip including a rail member having an elongated wire; and a second strip attachable to said inner surface of said bathtub in a generally opposite and raised location relative to said first strip, said second strip including a plurality of hook members, whereby when said top portion of said shower curtain is pushed outward over said upper edge at least one of said hook members will engage at least a portion of said elongated wire and retain said lower portion inside said enclosure.

10. A shower curtain retaining system comprising:

a shower curtain having top and lower portions;

a bathtub defining an enclosure around said shower curtain, said bathtub including a side wall having an inner surface and upper edge;

a first strip attachable to said lower portion of said shower curtain; and a second strip attachable to said inner surface of said bathtub in a generally opposite and raised location relative to said first strip, one of said first or second strips includes a rail member having an elongated wire, while the other of said first or second strips includes a plurality of hook members, whereby when said top portion of said shower curtain is pushed outward over said upper edge at least one of said hook members will engage at least a portion of said elongated wire and retain said lower portion inside said enclosure.

11. A method for retaining a shower curtain inside a bathtub when a portion of the shower curtain is forced outward over the bathtub, the shower curtain including a top portion and a lower portion, the bathtub including an inner surface and upper edge, a first strip attachable to the lower portion and a second strip attachable to the inner surface eof the bathtub in a generally opposite and raised location relative to the first strip, one of said first or second strips including a plurality of hook members, while the other of said first or second strips includes a rail member having an elongated wire comprising the steps of:

a) forcing the top portion of the shower curtain over the upper edge of the bathtub;

b) raising the lower portion of the shower curtain upward; and c) engaging the first strip with the second strip such that at least one of the plurality of hooks securely engages a portion of the elongated wire, thereby retaining the shower curtain inside the enclosure of the bathtub.

12. The method according to claim 11, wherein said step of engaging said first strip to said second strip includes at least one of said plurality of hook members engaging at least a portion of said rail member.

13. The method according to claim 11, wherein said step of engaging the first strip to the second strip allows uninhibited lateral side-to-side movement of the shower curtain by the user.

* * * * *